United States Patent [19]

Baker

[11] 4,179,062

[45] Dec. 18, 1979

[54] CARTON BLANKS AND CARTONS MADE THEREFROM

[76] Inventor: Brian G. Baker, 32, Shaftsbury Cir., South Harrow, Middlesex, England

[21] Appl. No.: 15,627

[22] Filed: Feb. 27, 1979

[30] Foreign Application Priority Data

May 31, 1978 [GB] United Kingdom ..... 25010/78

[51] Int. Cl.[2] ..... B65D 5/02

[52] U.S. Cl. ..... 229/37 R; 229/28 R

[58] Field of Search ..... 229/27, 28 R, 37 R

[56] References Cited

U.S. PATENT DOCUMENTS

| | | | |
|---|---|---|---|
| 1,847,598 | 3/1932 | Cornell | 229/37 R |
| 2,089,067 | 8/1937 | Myers | 229/27 |
| 2,524,516 | 10/1950 | Cody | 229/28 R |
| 2,693,902 | 11/1954 | Ross | 229/37 R X |
| 3,356,278 | 12/1967 | Layne, Sr. | 229/37 R X |
| 3,365,109 | 1/1968 | Kessler et al. | 229/37 R X |
| 3,586,233 | 6/1971 | McCulloch | 229/37 R |

*Primary Examiner*—Davis T. Moorhead

*Attorney, Agent, or Firm*—Browdy and Neimark

[57] ABSTRACT

A carton blank is provided which comprises a substantially rectangular portion with a series of flaps extending from both major sides of said substantially rectangular portion. Fold lines are provided across said portion in line with breaks between the flaps. The carton formed from the blank, when the flaps are folded down, comprises a defined volume which can receive goods sized in accordance therewith and be sealed. The carton formed from the blank also has an open slot beside said defined volume into which slot another carton can be slotted at a later date and sealed in position.

7 Claims, 7 Drawing Figures

CARTON BLANKS AND CARTONS MADE THEREFROM

FIELD OF THE INVENTION

The present invention relates to a carton blank which forms a carton for use in the packaging industry and is specifically adapted to allow part-filling of the carton with goods and sealing of the goods therein and subsequent insertion of more goods in another part at a later date at a different location.

OBJECTS OF THE INVENTION

It is an object of the invention to so shape a carton blank that the carton formed from the blank, when the flaps are folded into position, comprises at least one volume in the compartment, which volume can receive goods and can be sealed by securing the flaps covering the compartments.

An open slot is also defined in the compartment beside said at least one volume and accordingly it is another object of the invention to so shape the blank that this open slot is of such dimensions as to be able to receive another, smaller carton at a later date, this smaller carton perhaps containing different goods from the goods in the main volume defined by the carton blank but the basic, full carton now containing goods which would be sold as a set.

SUMMARY OF THE INVENTION

According to the present invention, in its broadest aspect, there is provided a carton blank comprising a substantially rectangular portion having first, second, third and fourth flaps along one major side of said substantially rectangular portion and, along the opposite major side of said substantially rectangular portion, a first flap directly opposite said first flap on said one major side and extending along a shorter length of said rectangular portion than does said first flap on said one major side, and a second flap directly opposite said third flap on said one major side and extending along a shorter length of said rectangular portion than does said third flap on said one major side, said flaps on said opposite major side being symmetrically disposed about a straight line which extends at right angles across said rectangular portion and passes centrally through said second flap on said one major side; the blank further comprising fold lines which extend across said substantially rectangular portion at right angles to said one major side from between the adjacent flaps on said one major side, the carton blank being such that, when the flaps are folded to form a carton, the carton comprises a defined volume which can receive goods size in accordance therewith and be sealed and further comprises an open slot beside said defined volume into which slot another, smaller carton can be slotted at a later date and sealed in position.

BRIEF DESCRIPTION OF THE DRAWINGS

Other objects and advantages of the invention will be readily apparent from the following detailed description of a preferred embodiment of carton blank and a carton formed therefrom, which description should be considered in conjunction with the accompanying drawings, in which.

DESCRIPTION OF PREFERRED EMBODIMENT

Figure 1:
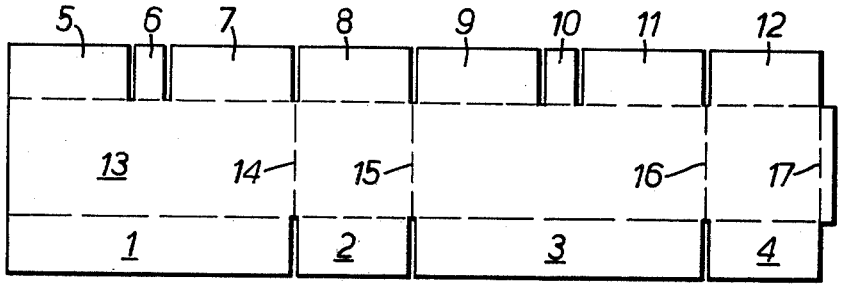
FIG. 1 is a plan view of a carton blank.

Referring firstly to FIG. 1, the blank of the first carton comprises a substantially rectangular portion 13 having four flaps 1–4 along one major side and eight flaps 5–12 along the opposite major side. The flaps 5, 6 and 7 are opposite the flap 1; the flap 8 is opposite the flap 2; the flaps 9, 10 and 11 are opposite the flap 3; and the flap 12 is opposite the flap 4. A fold line 14 extends across the portion 13 from between the flaps 1 and 2 to between the flaps 7 and 8. A fold line 15 extends across the portion 13 from between the flaps 2 and 3 to between the flaps 8 and 9. A fold line 16 extends across the portion 13 from between the flaps 3 and 4 to between the flaps 11 and 12. All the fold lines extend at right angles to the major sides of the portion 13. An end flap 17 is provided on the end of the portion 13 adjacent the flaps 4 and 12, this flap 17 serving as a stitch flap to be stitched to the opposite end of the portion 13, which forms four side walls of the carton, or it can be glued.

The flaps 1–4 form the base of the carton and the flaps 5–12 are at the top of the carton when the carton is assembled as shown in FIGS. 2–5. It will be seen that each of the flaps 5, 6 and 7 is symmetrically disposed with respect to flaps 11, 10 and 9, respectively, about a straight line which extends at right angles across the rectangular portion 13 and passes centrally through the flap 2. Of necessity, at least the flaps 5 and 11 and the flaps 7 and 9 each extend along a shorter length of the rectangular portion 13 than does each of the flaps 1 and 3. The symmetrical arrangement of flaps described above is such that, when the flaps are folded to form a carton, the carton comprises a defined volume which can receive goods sized in accordance therewith and be sealed and further comprises an open slot beside said defined volume into which slot another, similar carton can be slotted at a later date and sealed in position. In the example shown, the blank is such as to form a carton with two such defined volumes with the open slot between them.

The carton in intended to house goods such as loudspeaker cabinets as well as further goods, such as loudspeaker grilles, which are to be inserted at a different time and at a different place from the cabinets themselves.

Figure 2:
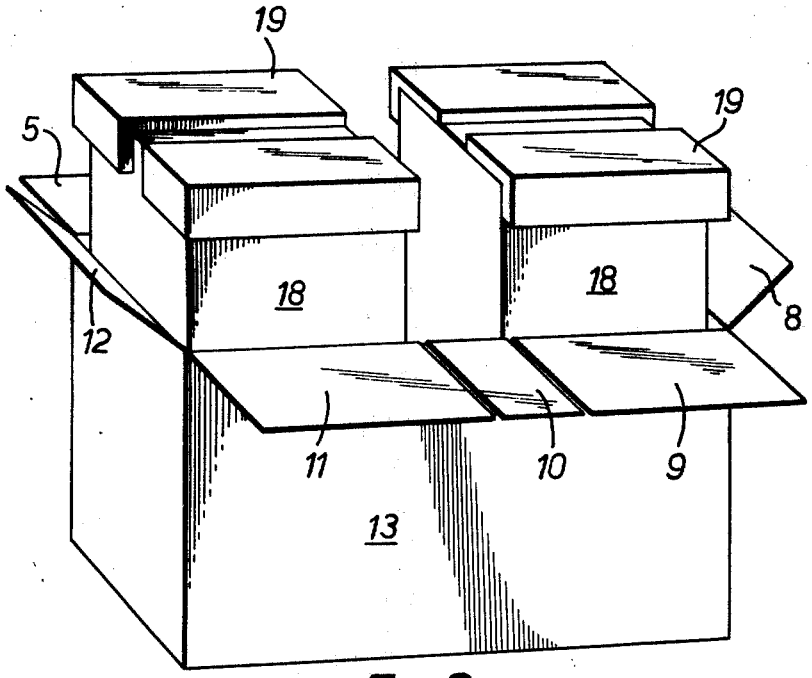
FIG. 2 is a perspective view showing a carton formed from the blank shown in FIG. 1, and illustrates how goods and packing can be inserted in the carton whilst leaving space for later insertion of a further integer between the goods.

FIG. 2 shows two cabinets 18 being inserted into the carton, suitable blocks 19 of, for example, polystyrene, being placed around upper and lower edges of the cabinets to serve as packing and protection for the goods.

It will be seen that the flaps 5 and 7 and the flaps 9 and 11 are each respectively longer than each of the flaps 6 and 10, the flaps 5, 7, 9 and 11 substantially corresponding to the width of each speaker cabinet 18, the flaps 5 and 11, 7 and 9, being able to define the two distinct volumes in the carton.

Figure 3A:
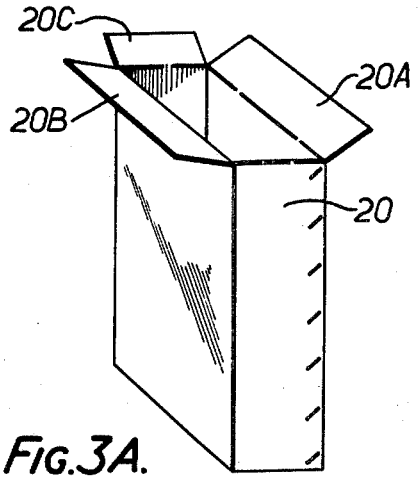
FIG. 3A is a perspective view of a second carton which is to be inserted in between the goods packed in the first carton.
Figure 3:
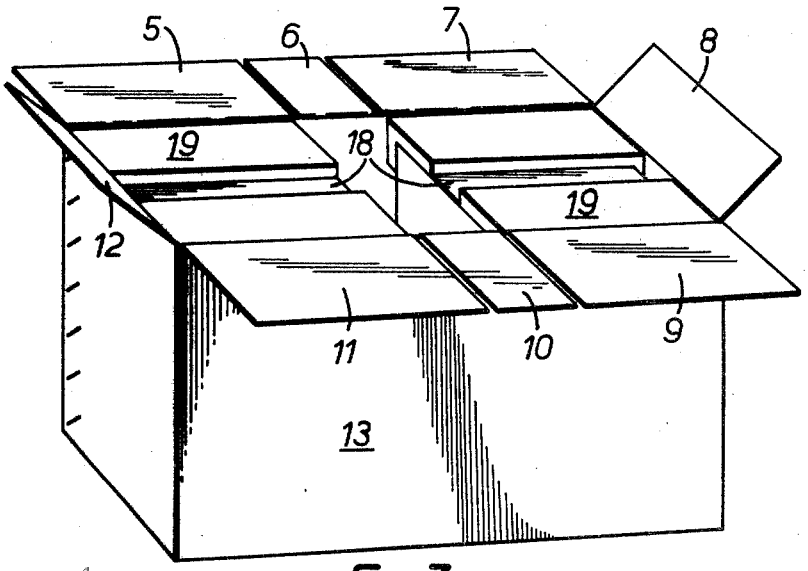
FIG. 3 is a view similar to FIG. 2 and shows the goods and packing in the carton.

As shown in FIG. 3A, a second carton 20, which is open at its top, is provided for insertion into the first carton in the open slot in between the two cabinets 18.

Figure 4:
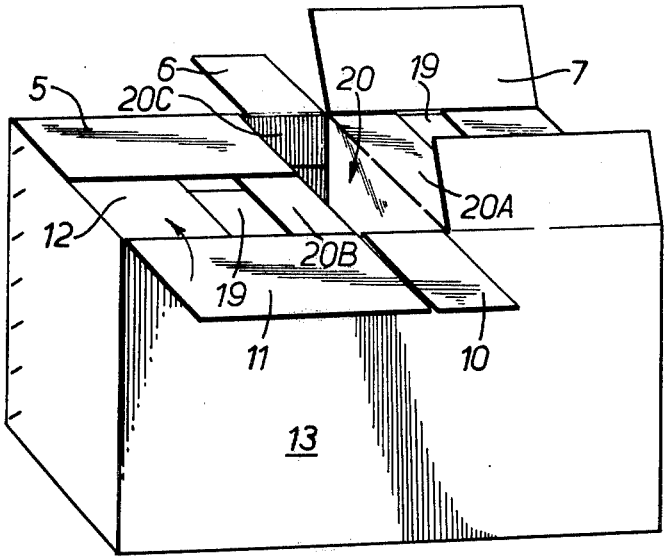
FIG. 4 is a perspective view illustrating how flaps of the first carton are folded to secure the second carton in place in the first carton and to seal the goods in the first carton.
Figure 5:
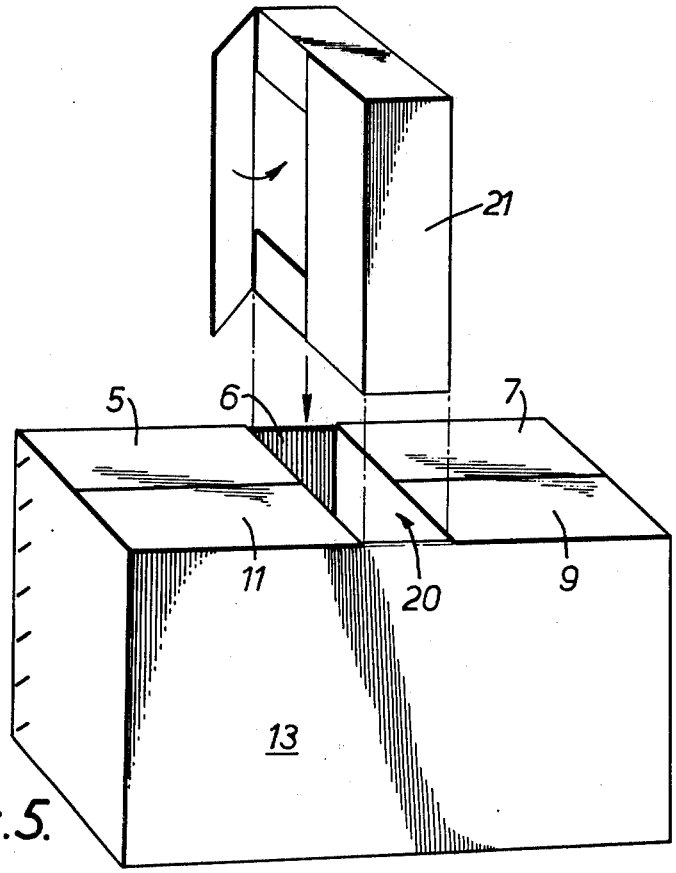
FIG. 5 is an exploded perspective view illustrating how a third carton containing further goods can be inserted within the open second carton at a later stage of packing the goods.

FIG. 4 shows how the flaps of the first carton are closed so as to be able to seal the containers 18 in it. It will be seen that the second carton 20 has been positioned in the first carton and its flaps 20A and 20B have been folded outwardly over the adjacent packing blocks 19. End flaps 20C of the second carton 20 are folded inwardly of the carton 20 and then the flaps 6 and 10 of the first carton are folded into the inside of the second carton 20, the flaps 6 and 10 being of slightly less width than the width of the carton 20. The flaps 8 and 12 are folded onto the tops of the packing blocks 19 and then the flaps 5, 7, 9 and 11 are folded over so that the carton assumes the form shown in the lower part of FIG. 5. The width of each flap 5, 7, 9 and 11 is half the total width of the first carton so that the pairs of flaps 5 and 11 and 7 and 9 meet when folded towards each other so that sealing tape, glue or staples, for example, can be provided to seal the cabinets in the first carton. The second carton 20 remains open and the whole package can then be transported to another location, prehaps in another country, for a separate package containing for example, the loudspeaker grilles, to be inserted in the second carton in the middle of the first carton. FIG. 5 shows a third carton 21 which is of slightly smaller dimensions than the second carton 20 so that the carton 21 can be slipped inside the carton 20 without having to interfere with the already sealed-in cabinets 18, the carton 21 containing the speaker grilles, for example. The carton 21 can then be secured by suitable means within the carton 20.

Figure 6:
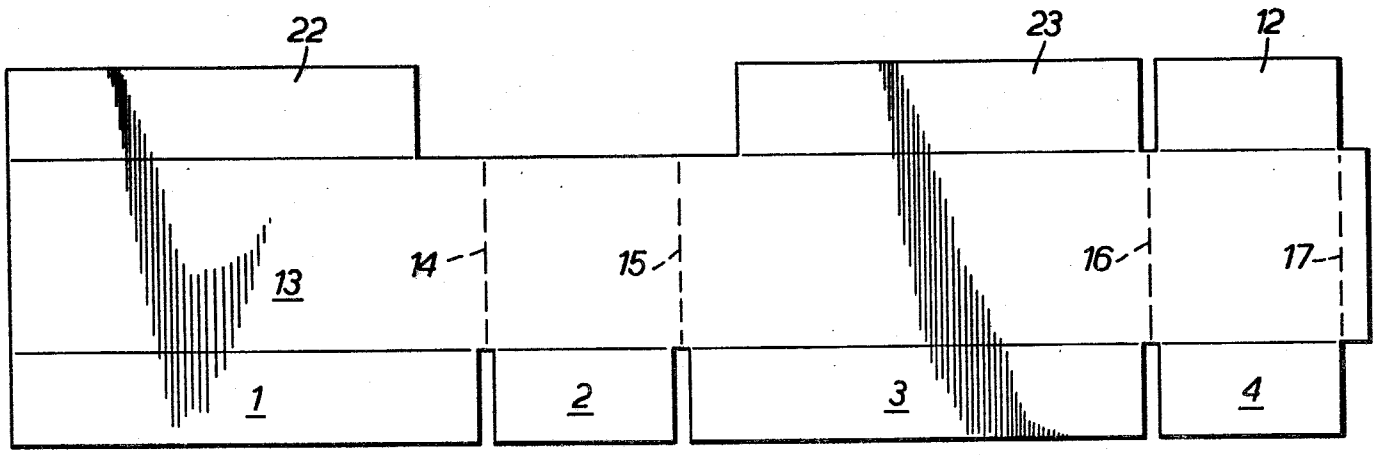
FIG. 6 is a plan view of another possible construction of carton blank to produce a carton in accordance with the invention.

Referring now to FIG. 6, another possible construction of carton blank is shown, this construction being simpler than that shown in FIG. 1.

As with the FIG. 1 version, the blank of FIG. 6 includes a substantially rectangular portion 13 having four flaps 1–4 along one major side of the portion 13. In contrast with the FIG. 1 version, however, only a single flap 22 is directly opposite the flap 1, the flap 22 effectively combining flaps 5 and 7 of the FIG. 1 version. Also, there is only a single flap 23 directly opposite the flap 3, the flap 23 effectively combining the flaps 9 and 11 of the FIG. 1 version. No flap is provided opposite the flap 2 and the spacer flaps 6 and 10 are also omitted. The flap 12 need not be provided either.

It will be seen that the flap 22 extends along a shorter length of the portion 13 than does the flap 1 and that the flap 23 extends along a shorter length of the portion 13 than does the flap 3. Also, the flaps 22 and 23 are symmetrically disposed about a straight line which extends at right angles across the portion 13 and passes centrally through the flap 2.

As with the FIG. 1 version, the blank shown in FIG. 6 is such that, when the flaps are folded to form a carton, the carton comprises a defined volume which can receive goods sized in accordance therewith and be sealed and further comprises an open slot beside said defined volume into which slot another, smaller carton can be slotted at a later date and sealed in position.

It can be envisaged from FIG. 6 that said slot will be at one end of the carton formed from the blank (the equivalent of the right-hand end of the carton shown in FIG. 2) rather than in the middle of the carton.

What is claimed is:

1. A carton blank comprising a substantially rectangular portion having first, second, third and fourth flaps along one major side of said substantially rectangular portion and, along the opposite major side of said substantially rectangular portion, a first flap directly opposite said first flap on said one major side and extending along a shorter length of said rectangular portion than does said first flap on said one major side, and a second flap directly opposite said third flap on said one major side and extending along a shorter length of said rectangular portion than does said third flap on said one major side, said flaps on said opposite major side being symmetrically disposed about a straight line which extends at right angles across said rectangular portion and passes centrally through said second flap on said one major side; the blank further comprising fold lines which extend across said substantially rectangular portion at right angles to said one major side from between the adjacent flaps on said one major side, the carton blank being such that, when the flaps are folded to form a carton, the carton comprises a defined volume which can receive goods sized in accordance therewith and be sealed and further comprises an open slot beside said defined volume into which slot another, smaller carton can be slotted at a later date and sealed in position.

2. A carton blank according to claim 1 and comprising third and fourth flaps opposite said first flap on said one major side and adjacent said first flap on said opposite said major side, and further comprising fifth and sixth flaps opposite said third flap on said one major side and adjacent said second flap on said opposite major side, the middle ones of the three flaps opposite said first and third flaps, respectively, on said one major side of said substantially rectangular portion together defining said open slot in the completed carton.

3. A carton blank as claimed in claim 2 and further comprising a flap on said opposite major side opposite said second flap on said one major side, and a flap on said opposite major side opposite said fourth flap on said one major side.

4. A carton blank according to claim 1, wherein the sides of the carton are to be formed from said rectangular portion and wherein an end flap is provided on one end of said rectangular portion to enable the sides of the carton to be secured together.

5. A carton blank according to claim 3, wherein each flap has a width which is substantially half the intended width of the carton to be formed from the blank.

6. A carton formed from the blank according to claim 1.

7. A carton formed from the blank according to claim 2.

* * * * *